United States Patent [19]

Fedoris

[11] Patent Number: 4,662,954

[45] Date of Patent: May 5, 1987

[54] METHOD FOR IMPROVING BASE COATING FORMATION ON SILICON STEEL BY CONTROLLING WINDING TENSION

[75] Inventor: Michael A. Fedoris, Export, Pa.

[73] Assignee: Allegheny Ludlum Corporation, Pittsburgh, Pa.

[21] Appl. No.: 765,410

[22] Filed: Aug. 13, 1985

[51] Int. Cl.[4] ..... H01F 1/04

[52] U.S. Cl. ..... 148/112; 148/113

[58] Field of Search ..... 148/112, 113

[56] References Cited

U.S. PATENT DOCUMENTS

| | | | |
|---|---|---|---|
| 3,585,085 | 6/1971 | Fritz et al. | 148/113 |
| 3,653,984 | 4/1972 | Urushiyama et al. | 148/113 |
| 4,290,829 | 9/1981 | Koshiishi et al. | 148/130 |

*Primary Examiner*—John P. Sheehan

*Attorney, Agent, or Firm*—Patrick J. Viccaro

[57] ABSTRACT

A method is provided for improving the core losses of silicon-iron steels, especially grain-oriented silicon steels, by improving the uniformity and quality of the base insulating coating; the method includes winding coated steel strip at winding tensions sufficient to form a coil having good coil integrity and sufficiently loose to improve base coating formation.

13 Claims, No Drawings

METHOD FOR IMPROVING BASE COATING FORMATION ON SILICON STEEL BY CONTROLLING WINDING TENSION

BACKGROUND OF THE INVENTION

This invention relates to a method of improving the uniformity and quality of the base insulating coating on silicon-iron steel. More particularly, this invention relates to a method of improving base coating formation on silicon steel and the magnetic quality thereof by controlling the tension of winding into coil form.

Silicon steel or silicon-iron steel is useful for its electrical and magnetic properties and may be as oriented or non-oriented steels. In the production of such steels, an annealing separator coating may be used to improve the magnetic properties and prevent sticking of coil laps during heat treatment. Annealing separator coatings are particularly useful with grain-oriented silicon steels.

Grain-oriented silicon steel produced in strip form is useful for various electrical applications, such as laminates used in transformer cores and the like. The desired grain orientation, such as cube-on-face or cube-on-edge, is produced during a final high temperature annealing operation. For such purposes, the silicon steel is hot rolled to form a hot-rolled band, pickled, and then cold rolled to final gauge by a series of cold-rolling operations with intermediate anneals, decarburized, coated with an annealing separator coating, and then final high temperature annealed in coil form to achieve the desired secondary recrystallization and grain orientation texture. The secondary recrystallization is achieved by inhibiting primary grain growth during stages of the annealing operation wherein this occurs. This is conventionally achieved by providing primary grain growth inhibitors, such as boron, manganese sulfides, and aluminum sulfides.

Prior to final texture annealing, the steel is conventionally coated with an annealing separator coating, such as magnesium oxide. Conventionally, such a coating may be applied by slurry coating, roller coating, dipping, or electrolytically coating the surfaces of the strip. The strip is then typically wrapped in coil form for final texture annealing at temperatures on the order of about 2200° F. (1404° C.). The annealing separator coating prevents the convolutions of the coil from bonding together during the high temperature annealing treatment, and in addition reacts with the silica present on the surface of the steel strip to form a strong forsterite or glass-insulating film. The coating also improves the magnetic properties of the silicon steel by removing sulfur after secondary recrystallization has taken place during the final high temperature texture annealing.

Moisture present in the annealing separator coating, such as in the form of magnesium hydroxide in the magnesium oxide coating, is liberated during initial stages of final texture annealing to cause transient oxidation of the steel surface as the iron reacts therewith to form iron oxides. Such excess moisture results in irregular coating of the steel having bare, uncoated areas and poor base coating development and deposits of reduced iron oxide on the strip surface. This poor surface quality impairs the magnetic performance of the steel for final electrical product applications. After final texture annealing of the silicon steel with the coating thereon, the steel strip is typically "scrubbed" to remove the annealing separator coating.

As used herein, the "performance", or, more specifically, "scrub performance" refers to the surface quality of the forsterite insulating coating, i.e., base glass coating, wherein poor surface quality is characterized by uncoated areas and iron oxide deposits.

Attempts have been made by others to improve the annealing separator coating in order to result in better scrub performance. Furthermore, in a co-pending U.S. application, Ser. No. 607,889, filed May 7, 1984 now U.S. Pat. No. 4,582,547 and assigned to the common Assignee of the present application, there is disclosed a method for producing an annealing separator coating on silicon steel prior to final texture annealing to improve the coating uniformity and prevent oxidation of the steel surface during annealing by applying to the steel a coating such as magnesium oxide having as an addition an inert high termperature refractory annealing separator agent in the form of particles.

Accordingly, it is a primary object of the present invention to provide a method for improving the scrub performance of the grain-oriented silicon steel without modifying the annealing separator coating while avoiding the adverse effects of liberated water.

A further object is to substantially eliminate the iron oxide deposits on the silicon steel surface resulting from excess moisture between the coil laps.

It is also an object to improve the base coating development to provide better uniformity and quality of the coating.

A further object is to improve the core losses of silicon-iron strip and particularly cube-on-edge oriented silicon steel.

These and other objects of the invention, as well as a more complete understanding thereof, may be obtained from the following description and specific examples.

SUMMARY OF THE INVENTION

In accordance with the present invention, a method is provided for improving the core losses of silicon-iron steel strip which has been hot rolled, cold rolled to final gauge between about 0.007 to 0.018 inch (0.178 to 0.457 mm), decarburized and coated with an annealing separator coating. The method comprises winding the coated strip at a winding tension sufficient to form a coil having good coil integrity and sufficiently loose to improve base coating formation characterized by uniformity and the absence of oxidation of the steel surface after final high temperature texture annealing. The winding tension is within the range of about 4340 to 14,110 psi and is inversely proportional to the strip gauge. The coil of coated strip is thereafter final high temperature annealed. By the present invention, winding of the coated strip is conducted at winding tensions sufficient to form a coil having good coil integrity and coil wraps sufficiently loosely separated to permit venting of moisture evolved during final high temperature texture annealing to improve base coating formation characterized by uniformity in the absence of iron oxide deposits and thereby improve the core losses of the steel.

DETAILED DESCRIPTION OF THE PREFERRED EMBODIMENTS

Broadly, in the practice of the invention, a silicon-iron steel of a conventional composition is hot rolled to form hot-rolled band which is then cold rolled, generally by a series of cold-rolling operations with or without intermediate anneals to a final product gauge. The strip is then normalized, decarburized, and coated with an annealing separator coating, wound into coil form, and final high temperature texture annealed. In accordance with the invention, after the coating operation, the strip is wound to form a coil wherein the tension during winding of the strip into coil form is controlled. A lower winding tension than is conventional practice is used in accordance with the practice of the invention to allow gases, especially water vapor, to more easily escape from the coil wraps during the early stages of the final high temperature texture annealing operation. Consequently, the liberated water is not available for reaction with the steel to form transient iron oxides. This permits the desired reactions to occur during the final texture annealing to result in an improved base coating development and results in improved magnetic quality, as shown by the reduced core losses.

Although the method of the invention has utility with respect to silicon-iron, and particularly grain-oriented steel generally, and specifically with cube-on-edge grain-oriented silicon steel, the following typical composition, in percent by weight, is one example of silicon steel useful with the method of the invention:

| C | Mn | S | Cu | Si | Fe |
|---|---|---|---|---|---|
| 0.03 | 0.065 | 0.025 | 0.22 | 3.15 | Balance |

Though the particular annealing separator coating composition does not form a part of the present invention, those coatings which tend to liberate moisture during the final high temperature texture annealing step will be most benefited during the development of the base glass coating. Particularly, methods of producing silicon steel which include using annealing separator coatings containing magnesia or magnesium oxide can be improved by the present invention.

In controlling the winding tension, it is important to insure that the coils are not wound too tightly or too loosely. If the coils are wound too tightly, moisture present in the annealing separator coating, such as a magnesium oxide coating, may be liberated to cause transient oxidation of the steel surface as some of the water is reacted with the steel to form iron oxides. This results in irregular coating with the strip having uncoated areas, as well as deposits of reduced iron oxides on the surface of the strip. This poor surface quality impairs the performance of the steel and the magnetic property of core loss in final electrical product applications. At lower winding tensions, oil canning may result during the winding operation if the tensions are too low. Furthermore, if the winding tension is too loose, it may result in oscillation of the strip as being wound. Still further, if the tension is too low, the coil integrity is diminished in that the center of the coil may not be firmly in place and may fall out.

Though there are numerous factors in addition to the winding tension which is the subject of the present invention that affects the overall magnetic quality of the material, the present invention is directed only to the winding tension. Such other factors include the particular final normalizing cycle, the final texture annealing cycle, and the type of annealing separator coating used.

For purposes herein, the term "winding tension" may be defined as a mathematical relationship to describe the force exerted on the strip during the coating and winding operation as a function of the winding reel motor amperage (DC), motor voltage, line speed, strip gauge, and strip width. The relationship may be expressed as follows:

$$\text{Horsepower (HP)} = \frac{\text{Amps} \times \text{Volts}}{746 \; \frac{(\text{Amp} - \text{Volts})}{\text{HP}}} \times .95 \qquad (1.0)$$

$$\text{Tension (lbs.)} = \frac{\text{HP} \times 33{,}000 \text{ (Ft-lb/min HP)}}{\text{Line speed (Ft/min)}} \qquad (2.0)$$

$$\text{Tension (PSI)} = \frac{\text{Tension (lbs)}}{\text{Gauge (in.)} \times \text{Width (in.)}} \qquad (3.0)$$

The above equations can be combined to establish a relationship of winding tension as a function of winding reel motor amperage, which can be useful for controlling the winding tension. For example, for a motor having a voltage of 270 volts and a line speed of 650 feet per minute, the following equation results:

$$\text{Tension (PSI)} = \frac{17.46 \text{ (lb/amp)} \times \text{Amps}}{\text{Gauge (in.)} \times \text{Width (in.)}} \qquad (4.0)$$

From this equation, at a given strip width and gauge, the winding reel motor amperage may be varied to achieve different winding tensions. Calculated tensions for various gauges are shown in the following Table I as a function of amperage.

TABLE I

| Relative Tension (%) | Amperage (Amps) | Calculated Tension (PSI)* Nominal Gauge (in.) .007 | .009 | .011 | .014 | .018 |
|---|---|---|---|---|---|---|
| 100 | 215–220 | 15680 | 12760 | 10450 | 8070 | 6200 |
| 90 | 200 | 14110 | 11480 | 9410 | 7260 | 5580 |
| 85 | 190 | 13320 | 10850 | 8890 | 6860 | 5270 |
| 80 | 175 | 12540 | 10210 | 8360 | 6460 | 4960 |
| 75 | 165 | 11750 | 9570 | 7840 | 6060 | 4650 |
| 70 | 155 | 10970 | 8930 | 7320 | 5650 | 4340 |

*All calculated results were derived for a nominal 35 in. wide coil and line speed of 650 FPM and rounded to the nearest +/− 10 psi.

As may be seen, the winding tension is inversely proportional to the strip gauge at a given strip width and line speed. Furthermore, as shown by the table, the amperage may be expressed in terms of relative tension in percentage based on the total amperage available to the winding reel motor and a downward adjustment thereof. The actual useful winding tensions which are sufficient to form a coil having good coil integrity and sufficiently loose to improve the base coating formation were determined by experimentation.

In order to more completely understand the invention, the following examples are presented.

EXAMPLE I

Numerous coils of grain-oriented silicon steel strip having a composition similar to that typical composition of silicon steel identified above were coated and coiled at various tension levels. The coils were coated with a water slurry of a magnesium oxide-containing coating. The coated strips were coiled in accordance with the present invention and were tested for magnetic properties and were compared to conventionally processed commercial coils of 9-mil gauge (0.009 inch). The conventionally wound coils were at a tension ranging from 12,070 to 13,535 PSI and the tension of the coils wound in accordance with the practice of the present invention were about 10,440 PSI. The magnetic properties tested were core loss in watts per pound (WPP) at inductions of 15 kilogauss and 17 kilogauss (KG), permeability at a field of 10 H (oersteds) and coercive force ($H_c$) at an induction of 200 B. The properties were determined at both the poor end (P.E.) and the good end (G.E.). The scrub performance of the coils was also determined. The results of these tests are set forth in Table II.

TABLE II

| Tension (PSI) | # Coils | WPP @ 15 KG P.E. | WPP @ 15 KG G.E. | WPP @ 17 KG P.E. | WPP @ 17 KG G.E. | Mu @ 10 H P.E. | Mu @ 10 H G.E. | $H_c$ @ 200 B P.E. | $H_c$ @ 200 B G.E. | # Coils Scrubbed | % OK |
|---|---|---|---|---|---|---|---|---|---|---|---|
| 10,440 (Pres. Inv.) | 1028 | .441 | .428 | .662 | .638 | 1837 | 1849 | .0165 | .0152 | 357 | 60 |
| 12,070 to 13,535 (Conventional) | 2347 | .447 | .434 | .670 | .645 | 1839 | 1849 | .0174 | .0160 | 480 | 47 |

The magnetic properties of the coils wound at a tension of 10,440 PSI in accordance with the practice of the invention showed improvements with regard to core loss at both 15 KG and 17 KG and with respect to the low induction coercive force at 200 B when compared to the conventional commercially wound coils at higher tension levels. Such improvements in properties were generally seen at both the poor end and good end of the coils. The Table also shows that of those coils scrubbed, 60% of the coils processed in accordance with the invention exhibited satisfactory coating performance, i.e., there was an absence of transient iron oxidation and bare uncoated areas as compared to only 47% of the coils processed at higher tension levels.

EXAMPLE II

In a manner similar to Example I, additional 9-mil coils of the same typical steel composition were wound in accordance with the present invention at 10,440 PSI and compared to coils wound at higher tension levels ranging from 12,510 to 13,960 PSI. Coils processed in accordance with the invention had improved core loss at both 15 KG and 17 KG and improvements in low induction coercive force at 200 B when compared to those coils wound at the higher tension levels. Furthermore, of those coils which were scrubbed, 68% of the coils processed in accordance with the present invention exhibited satisfactory coating performance, whereas only about 47% of the coils processed at the higher tension levels exhibited satisfactory coating performance.

TABLE III

| Tension (PSI) | # Coils | WPP @ 15 KG P.E. | WPP @ 15 KG G.E. | WPP @ 17 KG P.E. | WPP @ 17 KG G.E. | Mu @ 10 H P.E. | Mu @ 10 H G.E. | $H_c$ @ 200 B P.E. | $H_c$ @ 200 B G.E. | # Coils Scrubbed | % OK |
|---|---|---|---|---|---|---|---|---|---|---|---|
| 10,440 (Pres.) Inv.) | 190 | .439 | .425 | .664 | .634 | 1840 | 1856 | .0157 | .0137 | 63 | 68 |
| 12,510 to 13,960 (Conventional) | 39 | .446 | .432 | .681 | .646 | 1830 | 1856 | .0151 | .0139 | 18 | 47 |

As was an object of the present invention, the reduced winding tensions result in improved magnetic quality and specifically, improved core loss and low induction properties. Furthermore, the use of reduced winding tensions in forming a coil after coating and prior to final texture annealing results in an overall improvement in coating performance.

Although preferred and alternative embodiments have been described, it will be apparent to one skilled in the art that changes can be made therein without departing from the scope of the invention.

What is claimed is:

1. A method for improving core losses of silicon-iron steel strip which has been hot rolled, cold rolled to final gauge between about 0.007 to 0.018 inch at full width, decarburized and coated with an annealing separator coating, the method comprising:

winding the full width coated strip at winding tensions sufficient to form a coil having good coil integrity and sufficiently loose to improve base coating formation characterized by uniformity and the absence of oxidation of the steel surface after final high temperature texture annealing, the winding tension being within the range of about 4340 to 14,110 PSI and inversely proportional to the strip gauge; and thereafter, final high temperature annealing the coil of coated strip.

2. The method as set forth in claim 1 wherein the winding tension ranges from about 4960 to 14,110 PSI.

3. The method as set forth in claim 1 wherein winding the coils are sufficiently loosely separated between coil wraps during the final high temperature annealing.

4. The method as set forth in claim 3 wherein winding the coils sufficiently loose permits venting of moisture evolved during the final annealing.

5. The method as set forth in claim 1 wherein the winding tension ranges from about 7840 to 14,110 PSI for strip gauge of about 0.011 to 0.007 inch.

6. The method as set forth in claim 1 wherein the strip is coated with an annealing separator coating of a magnesium oxide-containing material.

7. The method as set forth in claim 1 wherein the method produces cube-on-edge oriented silicon steel.

8. The method as set forth in claim 1 wherein for strip gauge of about 7 mils, the winding tension ranges from about 10,970 to 14,110 PSI.

9. The method as set forth in claim 1 wherein for strip gauge of about 9 mils, the winding tension ranges from about 8930 to 11,480 PSI.

10. The method as set forth in claim 1 wherein for strip gauge of about 11 mils, the winding tension ranges from about 7320 to 9410 PSI.

11. The method as set forth in claim 1 wherein for strip gauge of about 14 mils, the winding tension ranges from about 5650 to 8070 PSI.

12. A method for improving core losses of grain-oriented silicon steel which has been hot rolled, cold rolled to final gauge at full width , decarburized and coated with an annealing separator coating containing magnesium oxide, the method comprising:

winding the full width coated strip at winding tensions sufficient to form a coil having good coil integrity and coil wraps sufficiently loosely separated to permit venting of moisture evolved during final high tempereature texture annealing to improve base coating formation characterized by uniformity and the absence of iron oxide deposits;

the winding tension being within the range of about 7840 to 14,110 PSI and inversely proportional to the strip gauge of about 0. 011 to 0.007 inch; and thereafter, final high temperature annealing the coil of coated strip to achieve a texture of cube-on-edge orientation.

13. In the production of grain-oriented silicon steel strip having improved core loss, a method for improving the performance of the coating applied to the strip prior to final high temperature texture annealing, the method comprising:

cold rolling the strip to final gauge of about 0.007 to 0.018 inch at full width;

applying an annealing separator coating to the strip;

winding the full width coated strip to form a coil with said winding being conducted at winding tensions to achieve good coil integrity with coil wraps sufficiently loosely separated to provide base coating formation characterized by uniformity and the absence of iron oxidation deposits;

said winding being within the range of about 4340 to 14,110 PSI and inversely proportional to the strip gauge; and thereafter, final high temperature texture annealing the coil of coated strip.

* * * * *